US009864389B1

(12) United States Patent
Vijaykumar

(10) Patent No.: US 9,864,389 B1
(45) Date of Patent: Jan. 9, 2018

(54) TEMPERATURE COMPENSATED REFERENCE VOLTAGE CIRCUIT

(71) Applicant: Analog Devices Global, Hamilton (BM)

(72) Inventor: Sharad Vijaykumar, Bangalore (IN)

(73) Assignee: Analog Devices Global, Hamilton (BM)

( * ) Notice: Subject to any disclaimer, the term of this patent is extended or adjusted under 35 U.S.C. 154(b) by 0 days.

(21) Appl. No.: 15/348,420

(22) Filed: Nov. 10, 2016

(51) Int. Cl.
*G05F 3/30* (2006.01)
*G05F 1/575* (2006.01)

(52) U.S. Cl.
CPC ..... *G05F 1/575* (2013.01)

(58) Field of Classification Search
CPC ..... G05F 3/00; G05F 3/02; G05F 3/04; G05F 3/08; G05F 3/10; G05F 3/16; G05F 3/185; G05F 3/26; G05F 3/30; G05F 1/567; H02M 3/155–3/158
USPC ..... 323/282, 284, 304, 311–317
See application file for complete search history.

(56) References Cited

U.S. PATENT DOCUMENTS 4,939,442 A 7/1990 Carvajal et al.
5,604,427 A 2/1997 Kimura
6,366,071 B1 4/2002 Yu
7,224,210 B2 5/2007 Garlapati et al.
7,321,225 B2 * 1/2008 Garlapati ..... G05F 3/30 323/313
7,420,359 B1 * 9/2008 Anderson ..... G05F 3/30 323/281
7,482,857 B2 1/2009 Song
9,285,820 B2 3/2016 Kalb et al.
9,600,015 B2 * 3/2017 Marinca ..... G05F 3/30
9,658,637 B2 * 5/2017 Marinca ..... G05F 3/262
2005/0122091 A1 * 6/2005 Marinca ..... G05F 3/30 323/316
2006/0001413 A1 * 1/2006 Marinca ..... G05F 3/30 323/315
2006/0197584 A1 * 9/2006 Hsu ..... G05F 3/30 327/539

(Continued)

FOREIGN PATENT DOCUMENTS

WO WO-2016127752 A1 8/2016

*Primary Examiner* — Adolf Berhane
(74) *Attorney, Agent, or Firm* — Schwegman Lundberg & Woessner, P.A.

(57) ABSTRACT

A delta-$V_{be}$ based bandgap reference voltage circuit generates a temperature stable reference voltage. First and second paths of the circuit each include a respective transistor coupled in series with a resistance. The collector current density of the transistor in first path is lower than the collector current density of transistor in the other path. A control path is used to generate a $2V_{be}$ voltage that is coupled to the base nodes of the resistors in each path. A resistance that is coupled between a common node of a first end of the two paths and a circuit ground node. The circuit current is controlled by this resistance and a voltage drop of $2\Delta V_{be}$ is across the resistance. The output reference voltage of the circuit is $2(V_{be}+\Delta V_{be})$ when stack resistors in each path are used.

24 Claims, 11 Drawing Sheets

(56) References Cited

U.S. PATENT DOCUMENTS

| | | | | |
|---|---|---|---|---|
| 2010/0007324 | A1* | 1/2010 | Masson | G05F 3/30 323/313 |
| 2010/0244808 | A1 | 9/2010 | Marinca | |
| 2010/0301832 | A1* | 12/2010 | Katyal | G05F 3/30 323/314 |
| 2016/0246317 | A1 | 8/2016 | Song | |
| 2016/0266598 | A1* | 9/2016 | Wong | G05F 3/267 |

* cited by examiner

TEMPERATURE COMPENSATED REFERENCE VOLTAGE CIRCUIT

FIELD OF THE DISCLOSURE

This document pertains generally, but not by way of limitation, to the field of reference voltage circuits and, in particular, to temperature compensated voltage reference circuits.

BACKGROUND

A bandgap voltage reference circuit is a temperature independent voltage reference circuit widely used in integrated circuits. Such a circuit is designed to produce a fixed voltage regardless of temperature changes. One example of a bandgap voltage reference circuit combines a complementary to absolute temperature (CTAT) circuit and a proportional to absolute temperature (PTAT) circuit to obtain a voltage relatively insensitive to temperature. One example of such a circuit is a Brokaw bandgap reference circuit.

The temperature coefficient (temp-co) of both CTAT and PTAT voltages should to be equal to obtain a zero temp-co of the reference voltage. Generally, the PTAT voltage has a lower temp-co and should be multiplied to obtain the temp-co in order to cancel the temp-co of the CTAT voltage. In a reference circuit, it is generally the PTAT voltage circuit that generates the most noise. Multiplying the generated PTAT voltage to obtain the temp-co also multiplies the noise.

SUMMARY OF THE DISCLOSURE

The present inventors have recognized, among other things, a need for a temperature stable reference voltage. The embodiments of a delta-$V_{be}$ voltage circuit may be cascaded to generate a relatively low noise PTAT voltage. Adding this PTAT voltage with a CTAT voltage in the right proportion can give a temperature stable reference voltage. Each delta $V_{be}$ voltage circuit produces its own bias current so that there is no need for separate bias current generators.

One embodiment of a bandgap reference voltage circuit for generating a temperature stable reference voltage output includes a plurality of paths, each path comprising a respective transistor, having a respective area, coupled in series with a respective resistance, wherein the collector current density of the transistor of a first path is lower than the collector current density of other paths. A resistance is coupled between a reference voltage node and a first end of each path. An input node of the circuit is coupled to a base node of the transistor in the first path, an output node of the circuit is coupled to a base node of the transistor of the second path. An amplifier circuit is coupled between the respective transistors and resistances of each of the plurality of paths. A current source is coupled to a second end of each path, the current source coupled to and controlled by the amplifier circuit.

Another embodiment includes a cascaded bandgap reference voltage circuit for generating the temperature stable reference voltage output. The cascaded circuit comprises a plurality of delta $V_{be}$ voltage circuits, each bandgap reference voltage circuit includes a plurality of paths, each path comprises a respective transistor, having a respective area, coupled in series with a respective resistance, wherein the collector current density of the transistor of a first path is lower than the collector current density of other paths. A resistance is coupled between a reference voltage node and a first end of each path. An input path comprises a transistor having the second area, the input path coupled between the reference voltage node and base of the transistors of the plurality of paths, an output node of the circuit coupled to the base of the transistors of the plurality of paths. An amplifier circuit is coupled between the respective transistors and resistances of each of the plurality of paths. A current source is coupled to a second end of each path, the current source coupled to and controlled by the operational amplifier. A voltage curvature correction circuit is coupled to the plurality of bandgap reference voltage circuits and configured to generate a curvature corrected reference voltage.

In another embodiment, a method for generating a temperature stable reference voltage in a reference voltage circuit comprises generating a first current in a first path comprising a first transistor having a first area. A second current is generated in a second path comprising a second transistor having a second area, wherein the collector current density of the first transistor is lower than the collector current density of the second transistor. A control voltage is generated and coupled to a base node of the first and second transistors. A current is controlled through the reference voltage circuit based on a resistance between a common node of the first and second paths and a ground node, the resistance having a delta voltage between the common node and the ground node. The reference voltage is output that is a sum of the control voltage and the delta voltage.

This section is intended to provide an overview of the subject matter of the present patent application. It is not intended to provide an exclusive or exhaustive explanation of the invention. The detailed description is included to provide further information.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Stacked delta-$V_{be}$ (base-to-emitter voltage) based band-gap reference circuits have been used extensively in stand-alone and embedded reference circuits to generate temperature compensated, relatively low noise reference voltages. One problem with conventional delta-$V_{be}$ circuits is the use of current mirrors to bias the bipolar junction transistors (BJTs).

Flicker noise, also known as 1/f noise, is a signal having a frequency spectrum such that the power spectral density (energy or power per Hz) is inversely proportional to the frequency of the signal. In order to reduce 1/f noise, the current mirrors may be implemented with either vertical PNP transistors that typically have a large area and may not be available in most processes or large p-type metal oxide semiconductor (PMOS) devices may be used.

Another way to overcome the 1/f noise problem is to use a cross connected quad (cross-quad) BJT structure. The drawbacks of this scheme include the lower delta-$V_{be}$ voltage generated for the same number of BJTs as well as the higher supply voltage requirement to bias two stacked $V_{be}$ circuits (e.g., BJTs).

The embodiments of a delta-$V_{be}$ circuit disclosed herein reduce the overall circuit area (as compared to a cross-quad delta-$V_{be}$ circuit) by using thin-film resistors instead of active current mirrors, thus reducing the 1/f noise. The disclosed delta-$V_{be}$ circuit does not need the two stacked BJTs to operate. Hence it can work with a lower voltage power supply. The disclosed embodiments are not limited to using thin-film resistors since any resistor will also operate properly. The use of thin-film resistors may reduce 1/f noise better than other resistors.

Figure 1A:
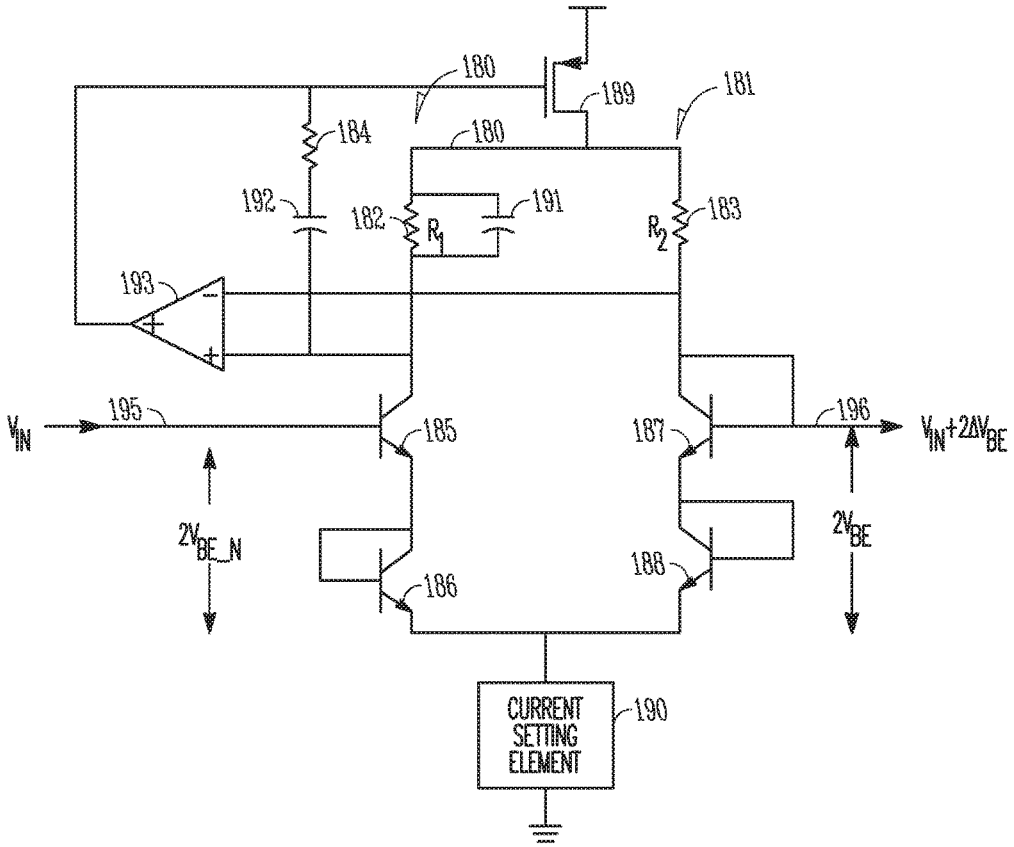
FIGS. 1A and 1B are schematic diagrams of a delta-$V_{be}$ (base-to-emitter voltage) voltage circuit, such as in accordance with various embodiments

FIG. 1A is a schematic of a delta-$V_{be}$ circuit. The delta-$V_{be}$ circuit includes transistors—185-189, resistances (e.g., resistors) 182-184, capacitances (e.g., capacitors) 191, 192, an amplifier circuit 193 (e.g., operational amplifier), a current source 189 (e.g., transistor), and a current setting element 190.

The circuit includes two paths 180, 181, each path 180, 181 including respective transistors 185, 186 and 187, 188 and respective resistances 182, 183 coupled in series. An input path 195 is coupled to a base of transistor 185. The amplifier circuit 193 has inputs coupled between the first and second paths 180, 181 such that one input (e.g., plus input) is coupled to a node between the resistance 182 and transistor 185. A second input (e.g., minus input) is coupled to a node between the resistance 183 and the transistor 187. The output of the amplifier circuit 193 is coupled to a control gate of transistor 189.

Capacitance 191 is coupled in parallel with resistance 182. Capacitance 192 is coupled in series with resistance 184. The capacitance 192 and resistance 184 form part of a feedback loop with the output of the amplifier circuit 193 and the positive input of the amplifier circuit 193. Transistors 185, 186 are coupled in series in the first path 180.

Transistors 187, 188 are coupled in series in the second path 181. A common node between the two paths is coupled to a current setting element 190 that is coupled to a ground reference node.

An input voltage (e.g., $2V_{be_n}$) is coupled to the input path 195 during operation of the circuit. The circuit generates $V_{in}+2\Delta V_{be}$ at the output node 196 of the circuit. One implementation of this circuit and a more detailed description of its operation is discussed subsequently with reference to FIG. 1B.

Figure 1B:
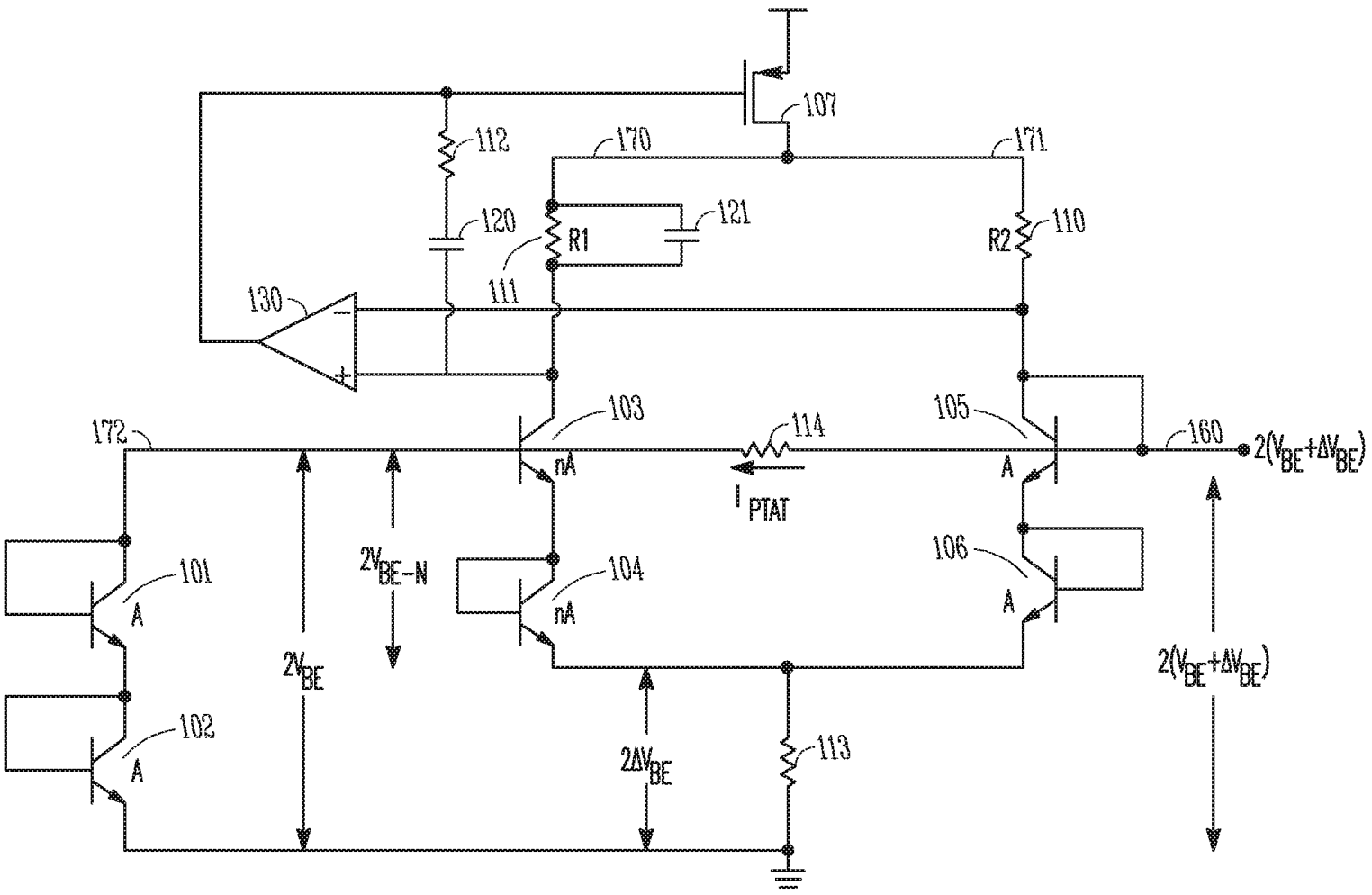

FIG. 1B is a schematic diagram of an implementation of the delta-$V_{be}$ cell based reference voltage circuit of FIG. 1A, such as in accordance with various embodiments. The delta-$V_{be}$ reference circuit includes transistors 101-107, resistances (e.g., resistors) 110-114, capacitances (e.g., capacitors) 120, 121, and an amplifier circuit 130 (e.g., operational amplifier).

In an embodiment, the transistors include BJTs 101-106 (e.g., npn) and a field effect transistor (FET) 107 (e.g., PFET). Other embodiments may use other types of transistors to achieve substantially the same results.

The structure of the delta-$V_{be}$ circuit includes two paths 170, 171. Each path includes respective pairs of transistors 103, 104 and 105, 106 coupled together in series (e.g., collector to emitter). The series couple transistors 103, 104 and 105, 106 are each coupled in series with a respective resistance 111, 110. While the schematic of FIG. 1 shows pairs of transistors 103, 104 and 105, 106 in each path, the circuit will operate properly with only one transistor 103, 105 in each respective path 170, 171. The second series coupled transistor 104, 106 provides improved performance. In an embodiment, a capacitance 121 is coupled in parallel to one of the resistances 111.

At least some of the transistors 104-106 in the two paths 170, 171 are each coupled in a diode connection. In other words, their respective base and collector nodes are coupled together. Consequently, the voltage drop across each respective transistor 103-106 is $V_{be}$ during circuit operation. Even though the transistors 104-106 are wired as diodes, a benefit to using transistors instead of diodes is that one transistor 104 in the first path 170 sets $V_{be}$ for a corresponding transistor 106 in the second path 171.

The relative fabrication areas of each of the transistors 101-106 is shown. For example, the first path includes transistors 103, 104 that have an area of nA whereas the transistors 101, 102 in the input path and the transistors 105, 106 in the second path 171 have an area of A, where $n \geq 1$. Thus, the transistors in the first path 170 can have the larger area.

The two paths 170, 171 are coupled together at a first end to a resistance 113 that is coupled to a reference voltage node (e.g., ground). The paths 170, 171 are also coupled together at a second end to the PFET 107 acting as a current source. The PFET 107 is coupled to a supply voltage node (e.g., $V_{DD}$).

An input path 172 includes transistors 101, 102 coupled together in series (e.g., collector to emitter). The emitter of one of the transistors 102 is coupled to the reference voltage node. The collector of the other transistor 101 is coupled to base connections of the transistors 103, 105 of the paths 170, 171 as well as the output of the circuit. In an embodiment, a resistance 114 is coupled between the base connections of the transistors 103, 105 through which an $I_{PTAT}$ (proportional to absolute temperature) current flows. The input path 172, during operation, generates an input voltage (e.g., $2V_{be}$) on the base nodes of the transistors 103, 105.

The amplifier circuit 130 is coupled between the respective transistors 103, 105 and resistances 111, 110 of the paths 170, 171. For example, a plus input of the amplifier circuit 130 is coupled to a first path 170 between resistance 111 and transistor 103. A minus input of the amplifier circuit 130 is coupled to a second path 171 between resistance 110 and transistor 105.

An output of the amplifier circuit 130 is coupled to and provides an operational voltage to a control gate of the current source transistor 107. This output is also coupled as a feedback circuit to a resistance 112 in series with a capacitance 120 that is coupled to the plus input of the amplifier circuit 130.

In operation, a supply voltage (e.g., positive voltage with respect to ground node) is applied to the supply voltage node. This biases the current source transistor 107 and causes a current to flow in the two paths 170, 171. The ratio of resistances 110, 111 of R1/R2 determines the current through these paths 170, 171. A resistance 114 between the second path 171 and the first path 170 provides some current flow from the second path 171 to be added to the current flow of the first path 170 that flows through the input path 172.

The resistors 111 and 110 and the value 'n' are chosen in such a way that the collector current density of 103 and/or 104 is lower than the collector current density of transistors in path 171 and 172. In other words, the sum of $V_{be}$ of 103 and 104 should be lower than the sum of $V_{be}$ of 101 and 102 and the sum of $V_{be}$ of 105 and 106.

The transistors 101, 102 of the input path provide a voltage of $2V_{be}$ on the base nodes of transistors 103, 105. Between the top transistor 103 and the node coupled to the two paths 170, 171 and the resistance 113 is a voltage of $2V_{be_n}$ that depends on the collector current density of the transistors 103, 104. Thus, a voltage of 2ΔVbe is across the resistance 113. The output node 160 then has an output voltage of $2V_{be}+2\Delta V_{be}$. The value of resistance 113 determines the current through the entire circuit in response to the $2\Delta V_{be}$ voltage across the resistance 113.

It is possible to get a larger current density through the smaller transistors 105, 106 of the second path 171 by decreasing resistance R2 110 as compared to resistance R1 111 that is in the path 170 with the larger area transistors 103, 104. In another embodiment, resistances R1 111 and R2 110 may also be adjusted to get an equal current through each path 170, 171.

The amplifier circuit 130, including the feedback loop comprising resistance 112 and capacitance 120, may be used to set the current input to the two paths 170, 171 based on the voltage across the two inputs of the amplifier circuit 130. The output voltage of the amplifier circuit is coupled to and controls the current source transistor 107 to maintain a relatively constant voltage at the node coupled to the two paths 170, 171 and the transistor 107. The noise of the amplifier circuit 130 added to the circuit is insignificant due to the resistance R1 111 multiplied by the transconductance of the transistor 103.

The capacitance 121 in parallel with the resistance R1 111 provides a bypass of the resistance R1 111 at higher frequencies. This may be used to compensate for the relatively larger parasitic capacitance of the larger area transistor 103 as described subsequently with reference to FIGS. 2 and 3.

Figure 2:
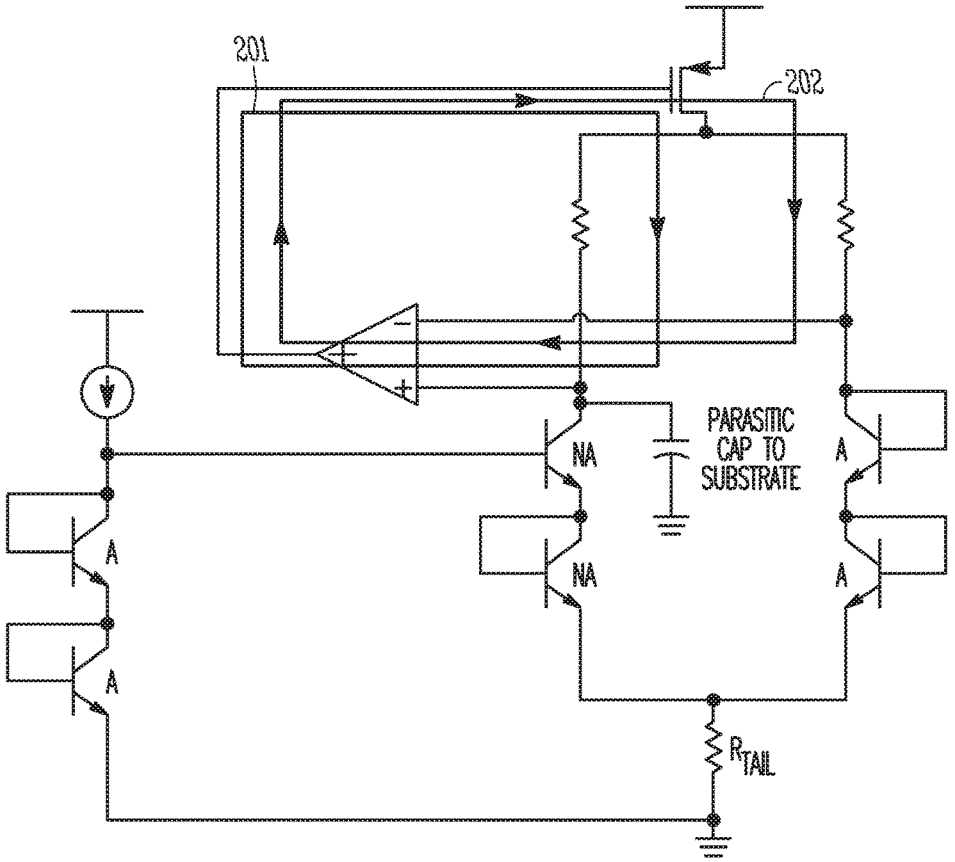
FIG. 2 shows a diagram of the delta-$V_{be}$ reference voltage circuit with negative and positive feedback paths through the amplifier circuit, such as in accordance with various embodiments.

FIG. 2 shows a diagram of the delta-$V_{be}$ reference voltage circuit with negative 201 and positive 202 feedback paths through the amplifier circuit, such as in accordance with various embodiments. Due to the relatively larger area of the transistor 103, there is relatively large parasitic capacitance 210 from the collector node to the substrate of the transistor 103. This capacitance 210 may reduce the gain of the negative feedback loop 201 at higher frequencies so that it may become less than the gain of the positive feedback loop 202 at those higher frequencies. This may result in the delta-$V_{be}$ circuit becoming unstable.

The bypass capacitance 121 that bypasses the resistance 111 at those higher frequencies thus provides improved stability. The resistor and capacitance combination 112 and 120 provides Miller compensation. Other frequency compensation techniques may also be used.

Figure 3:
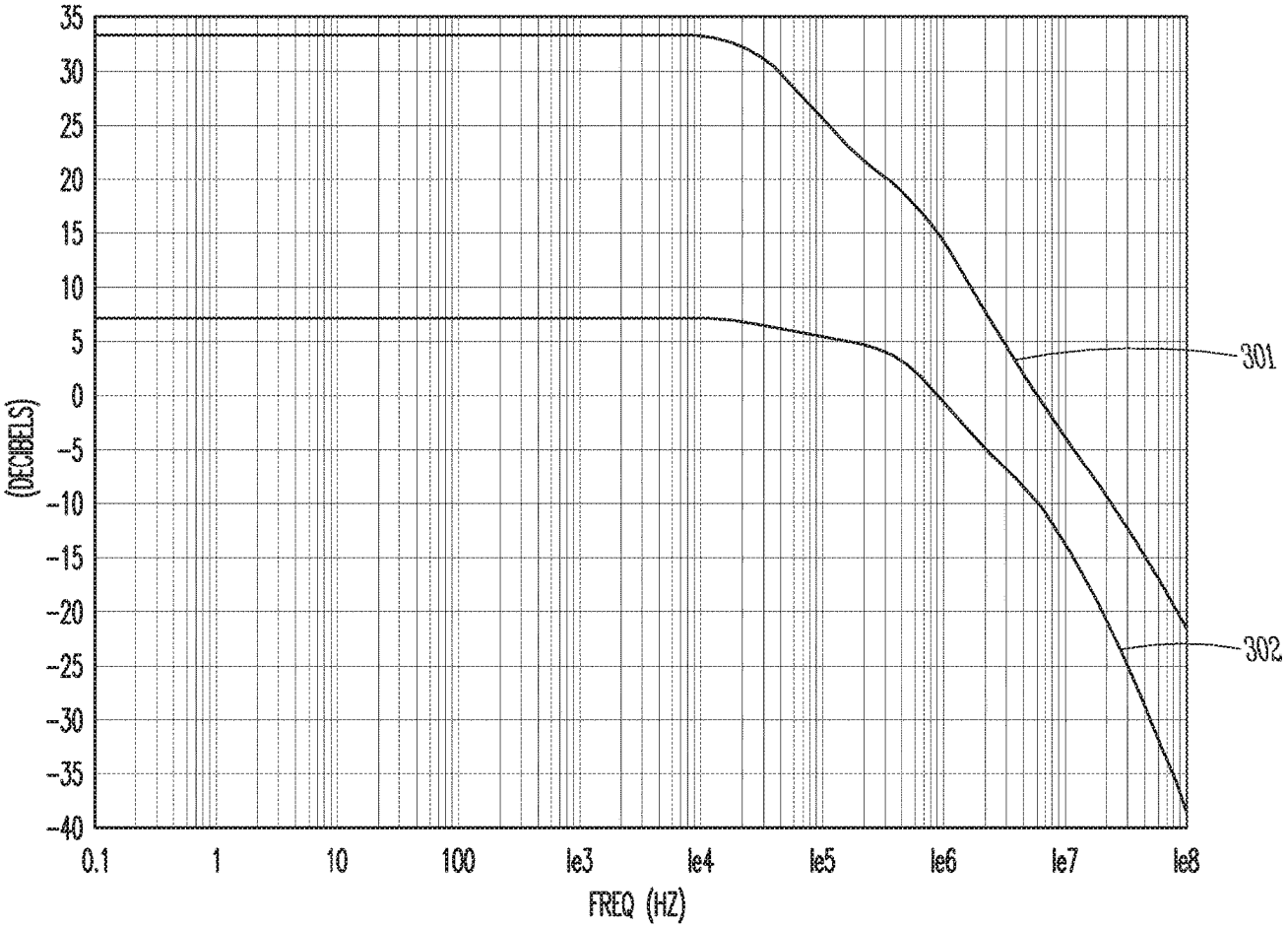
FIG. 3 is a plot of loop stability of the negative and positive feedback paths, such as in accordance with the embodiment of FIG. 2.

FIG. 3 is a plot of loop stability, such as in accordance with the embodiment of FIG. 2. The plot has frequency (in Hertz) along the x-axis and decibels along the y-axis.

This plot shows that the negative gain plot 301 is above the plot of the positive gain plot 302 at all frequencies. The negative gain is greater than positive gain at higher frequencies because of capacitance 121. This results in a more stable delta-$V_{be}$ circuit at all frequencies.

Figure 4:
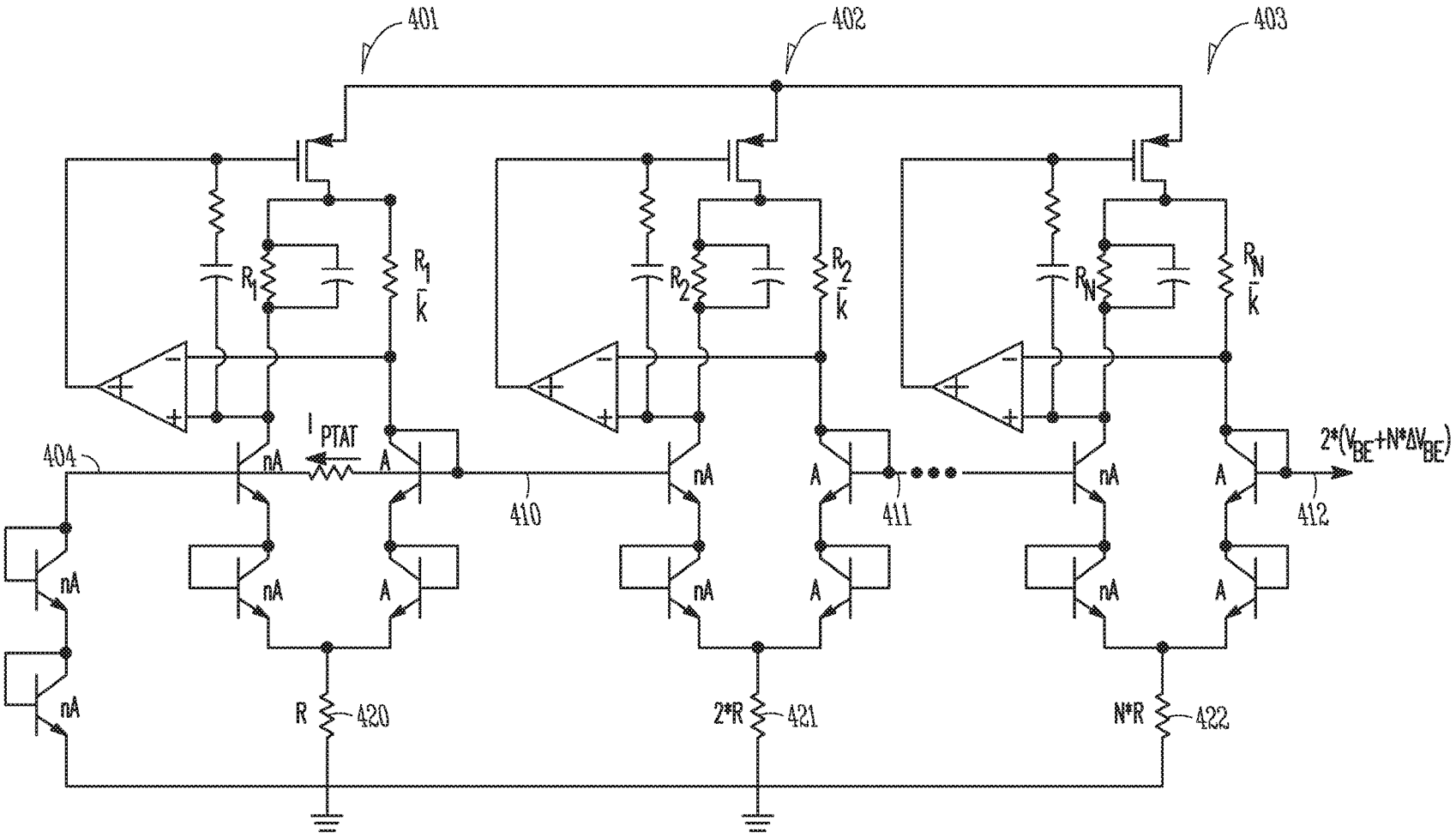
FIG. 4 is a schematic of a cascaded delta-$V_{be}$ reference voltage circuit, such as in accordance with the embodiment of FIG. 1.

FIG. 4 is a schematic of a cascaded delta-$V_{be}$ reference voltage circuit, such as in accordance with the embodiment of FIG. 1. This circuit includes a plurality of delta-$V_{be}$ voltage circuits 401-403. However, only one input path 404 may be necessary for all of the cascaded circuits 401-403.

When additional delta-$V_{be}$ voltage circuits 402, 403 are coupled in series to the output 410 of the first circuit 401, the $\Delta V_{be}$ of the respective circuit outputs 410-412 will be added to the $\Delta V_{be}$ of the previous output 410-412. For example, as seen above in FIG. 1, the output 410 of the first circuit 401 is $2(V_{be}+\Delta V_{be})$. Thus, coupling the second circuit 402 to the first circuit 401 results in $2(V_{be}+2\Delta V_{be})$. By the end of N cascaded circuits 401-403, the output 412 will be $2(V_{be}+N\Delta V_{be})$.

The current control resistances 420-422 may be scaled through each successive circuit. The first resistance 420 is R. The second resistance is 2*R. The $N^{th}$ resistance is N*R. This has the effect of providing the same current in each circuit 401-403 as the $\Delta V_{be}$ increases (e.g., $\Delta V_{be}$, $2\Delta V_{be}$, $4\Delta V_{be}$, . . . , $N\Delta V_{be}$) across that resistance 420-422 in successive circuits.

Figure 5:
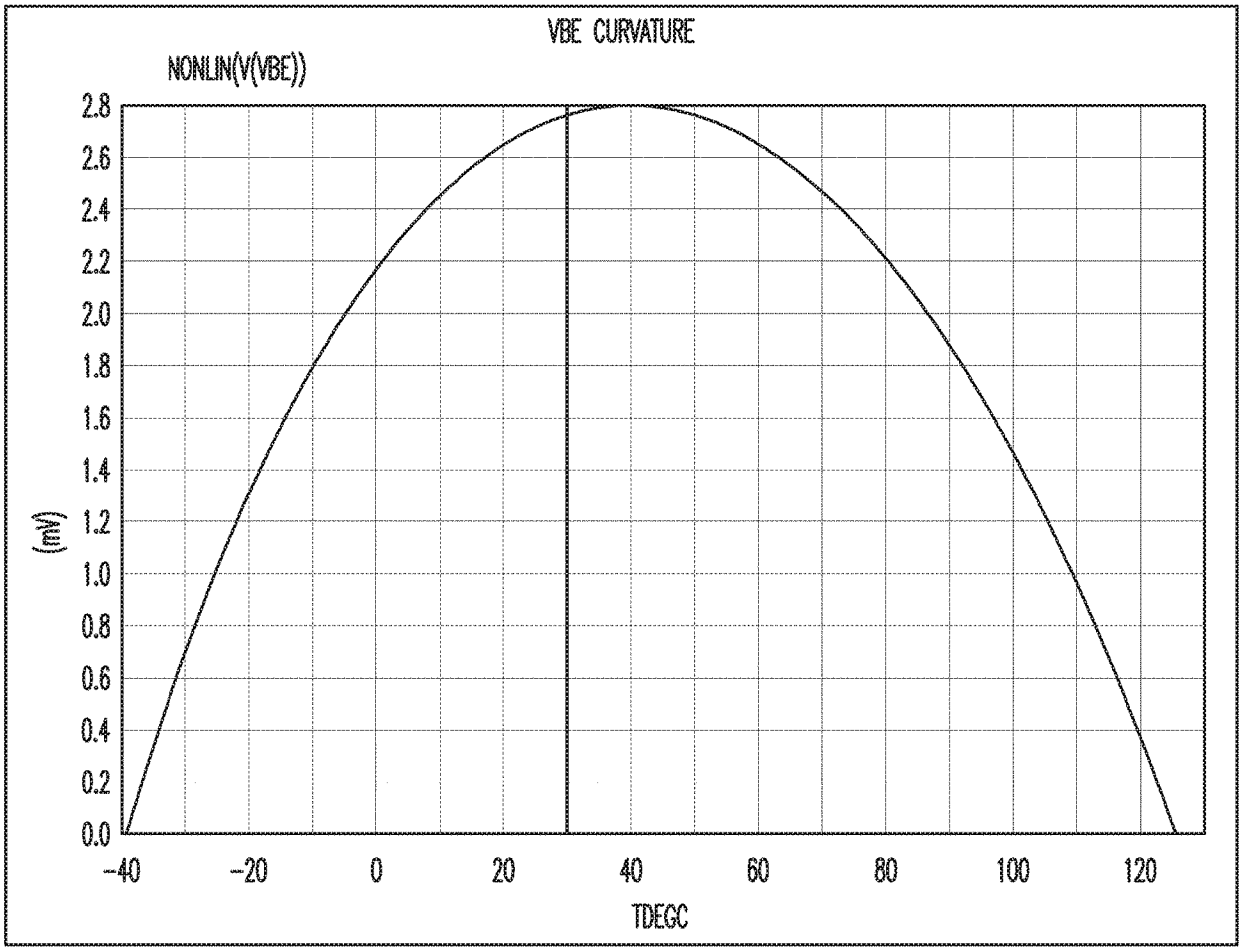
FIG. 5 is a plot of $V_{be}$ curvature, such as in accordance with various embodiments.

FIG. 5 is a plot of $V_{be}$ curvature, such as in accordance with various embodiments. This plot has temperature in degrees Celsius along the x-axis and millivolts along the y-axis.

Figure 7:
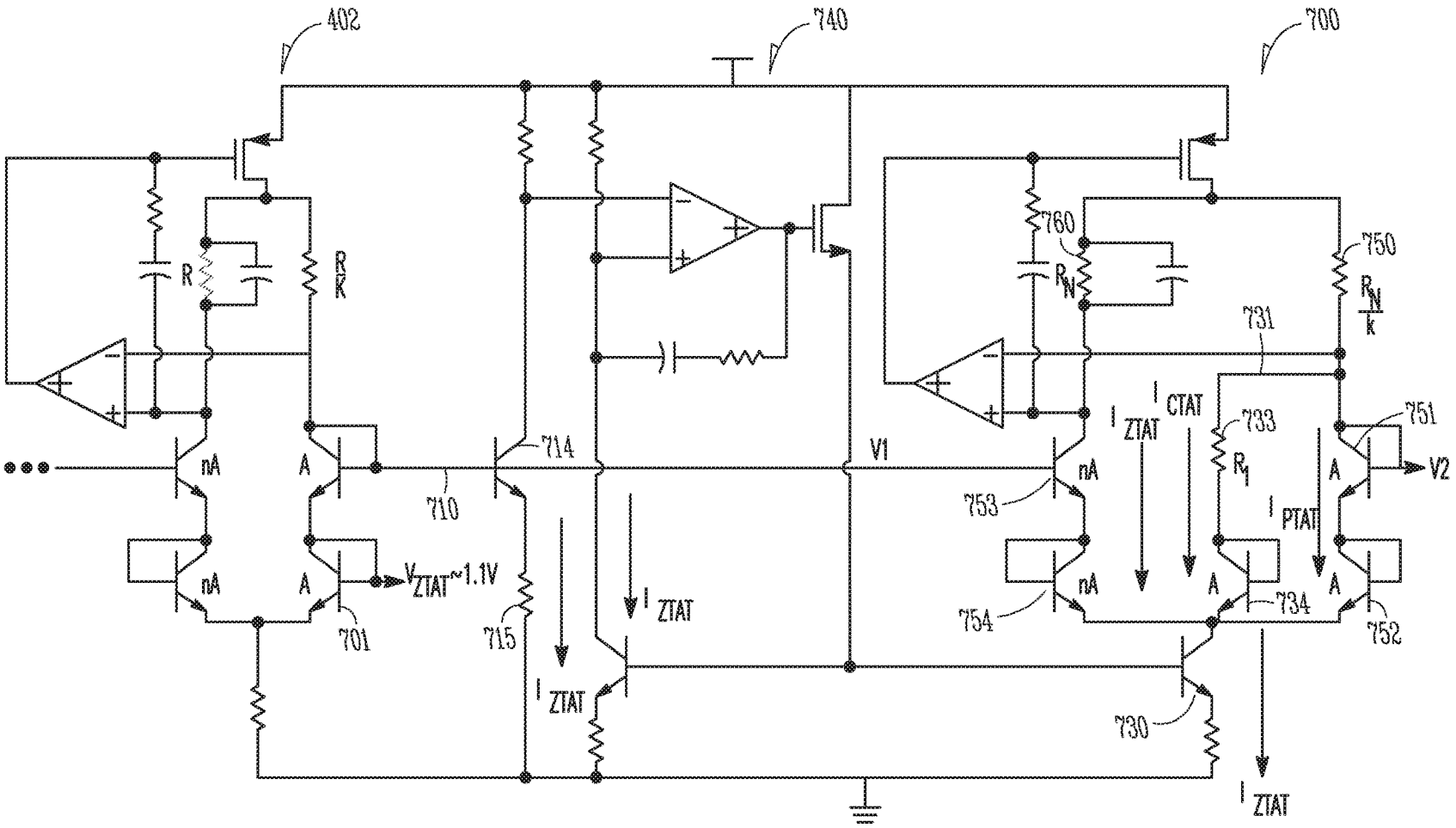
FIG. 7 is a schematic of a curvature correction circuit, such as in accordance with various embodiments.

This plot shows the non-linearity of $V_{be}$ from a range of −40° C. to +120° C. that may be expressed as $$V_{be} = E_G\left(1 - \frac{T}{T_M}\right) - V_T\ln(IS) + V_T\ln(I_C) - XTI * V_T * \ln\left(\frac{T}{T_M}\right)$$

where $E_G$ is the bandgap voltage, IS is the transport saturation current, $I_C$ is the collector current of the BJTs, and XTI is the temperature exponent of IS. The linear portion, $V_T\ln(IS)+V_T\ln(I_C)$, will be corrected by the $\Delta V_{be}$. In order to achieve greater linearity, the $$XTI * V_T * \ln\left(\frac{T}{T_M}\right)$$

term should be corrected as well by a curvature correction circuit, as illustrated in FIG. 7.

If a transistor (e.g., BJT) is biased with a PTAT current source (e.g., current is proportional to the absolute temperature), $I_C$ in the equation above becomes a function of temperature. Thus, the $$V_T\ln(I_C) - XTI * V_T * \ln\left(\frac{T}{T_M}\right)$$

terms may be combined to result in the equation:

$$V_{be,PTAT\ IC} = E_G\left(1 - \frac{T}{T_M}\right) - V_T \ln(IS) + (1 - XTI) * V_T * \ln\left(\frac{T}{T_M}\right).$$

A second $V_{be}$ that is biased with a constant current source results in $$V_{be} = E_G\left(1 - \frac{T}{T_M}\right) - V_T \ln(IS) + V_T \ln(IC) - XTI * V_T * \ln\left(\frac{T}{T_M}\right).$$

Figure 6:
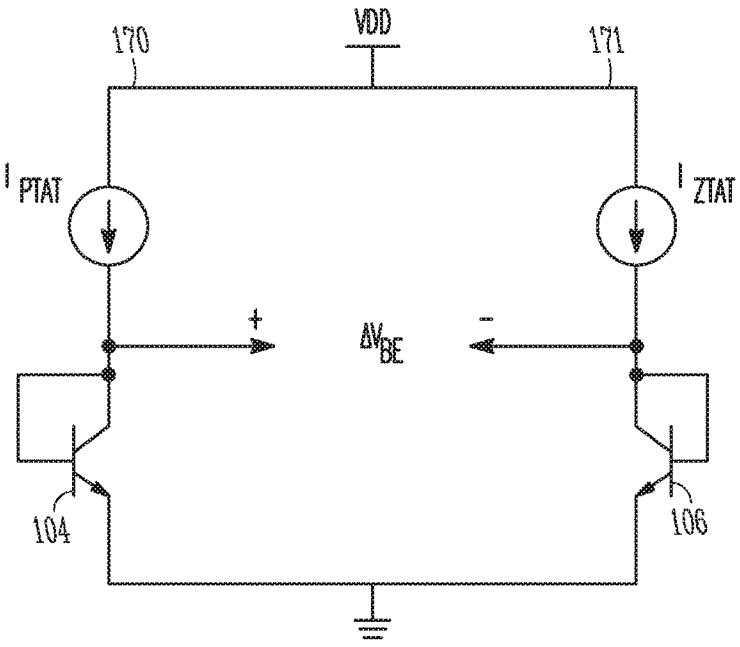
FIG. 6 is a schematic of a delta-$V_{be}$ reference voltage circuit model for curvature correction, such as in accordance with various embodiments.

The delta-$V_{be}$ of such a configuration is illustrated in FIG. 6.

FIG. 6 is a schematic of a delta-$V_{be}$ reference voltage circuit model for curvature correction, such as in accordance with various embodiments. This model shows the two paths 170, 171 with their respective transistors 104, 106 (e.g., BJTs). The current through the first path 170 is $I_{PTAT}$ and the current through the second path is $I_{ZTAT}$ (zero to absolute temperature). The $I_{ZTAT}$ current is almost a flat with respect to temperature. The non-linearity in $\Delta V_{be}$ in this case may be represented by $V_T$*ln(T). This non-linearity has been shown in FIG. 8. In an embodiment, this correction may be implemented in the circuit of FIG. 7.

FIG. 7 is a schematic of a curvature correction circuit, such as in accordance with various embodiments. The curvature correction circuit 700 is coupled to at least one of the cascaded circuits 402 of FIG. 4 through a temperature stable current source 740.

Assuming n=20 for the multiplier of the transistor area A and k=3 for the resistance divider of R/k, a voltage of approximately $V_{ZTAT}$~1.1V is produced at the transistor 701. The voltage at output node 710 is going to be $V_{ZTAT}$~$V_{be}$. The output node 710 is coupled to transistor 714 such that the output node voltage of $V_{ZTAT}$–$V_{be}$ is applied to the base node of the transistor 714. Across the resistance coupled between the transistor emitter node and the circuit reference (e.g., ground) is now a voltage of approximately 1.1V and the current through that resistance 715 is $I_{ZTAT}$. This current may be mirrored through the circuit to generate a current source that has $I_{ZTAT}$ as the output that will be approximately temperature stable.

The curvature correction circuit 700 comprises one of the delta-$V_{be}$ reference voltage circuits that has been modified to include a current source 730 and another path 731 having a resistance 733 coupled in series with a transistor 734 connected in a diode connection. The new path 731 is coupled to the node between the resistance $R_N$/k 750 and the transistor 751 as well as to the current source 730. The transistor 734 is optional. Same performance can be achieved even in the absence of transistor 734.

In operation, V1 is the input voltage to be corrected. V1=2$V_{be}$+2$\Delta V_{be}$. Since the current source 730 is a constant current source, the currents through resistances $R_N$ 760 and $R_N$/k are the $I_{ZTAT}$ currents. There is 2$V_{be}$ across the second path transistors 751, 752 and across the resistor 733 and transistor 734 of the center path 731. Thus, there is $V_{be}$ across the resistor 733 since the transistor 734 has $V_{be}$ across it. The $I_{ZTAT}$ current is a combination of $I_{CTAT}$ and $I_{PTAT}$. Since $V_{be}$/R1=$I_{CTAT}$ current that flows through this resistor 733, the $I_{CTAT}$ current is taken off the path with the $I_{ZTAT}$ current. The current flowing through the second path's transistors 751, 752 is the remaining $I_{PTAT}$ current while the $I_{ZTAT}$ current flows through the transistors 753, 754 in the other path. The resulting $V_{be}$ for the circuit, illustrated in FIG. 8, thus provides the curvature correction by being added to the $V_{be}$ output voltage from the delta-$V_{be}$ reference voltage circuit. The output voltage of the circuit is V2 that is the corrected delta-$V_{be}$ reference voltage.

Figure 8:
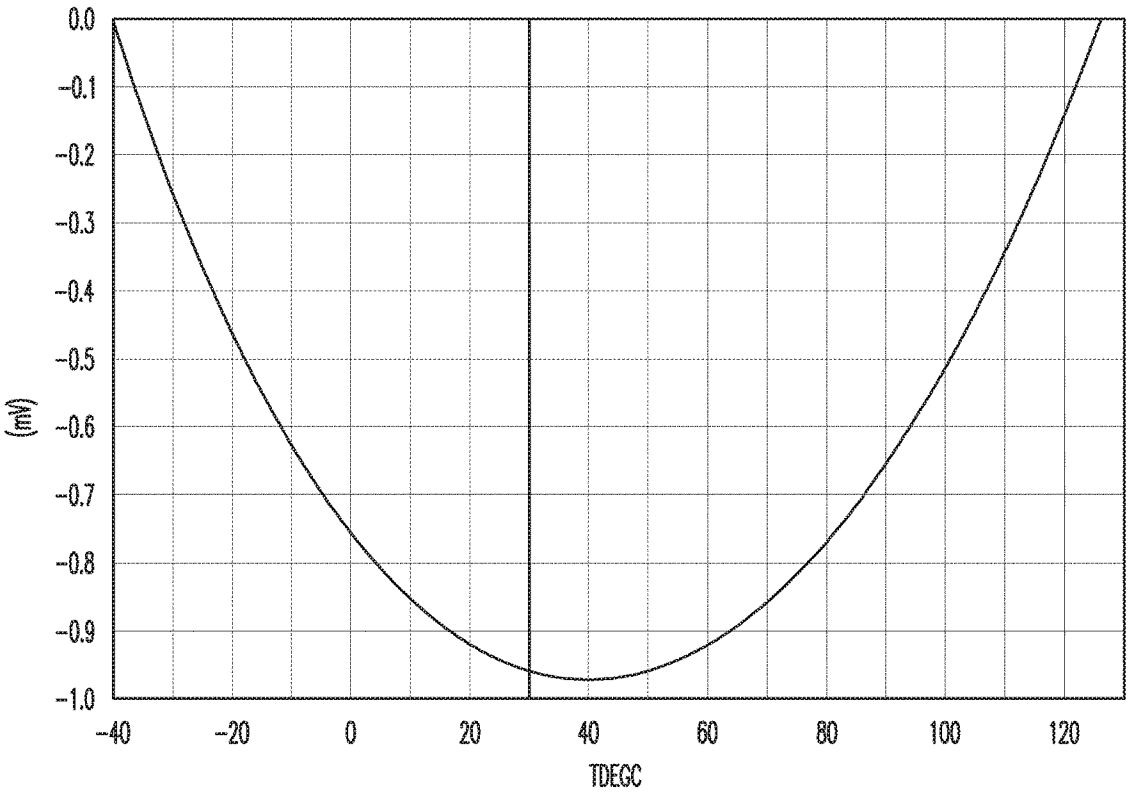
FIG. 8 is a plot of $V_{be}$ output curvature correction voltage, such as in accordance with embodiment of FIG. 7.

FIG. 8 is a plot of output curvature correction voltage, such as in accordance with embodiment of FIG. 7. This plot has temperature in degrees Celsius along the x-axis and mV along the y-axis.

The voltage of FIG. 8 is the curvature of the output voltage added by the curvature correction circuit. Comparing the voltage of FIG. 8 and the voltage of FIG. 5, it can be seen that they are substantially the inverse of each other. Thus, adding the output of the curvature correction circuit with $V_{be}$ reduces the curvature of the output reference voltage.

Figure 9:
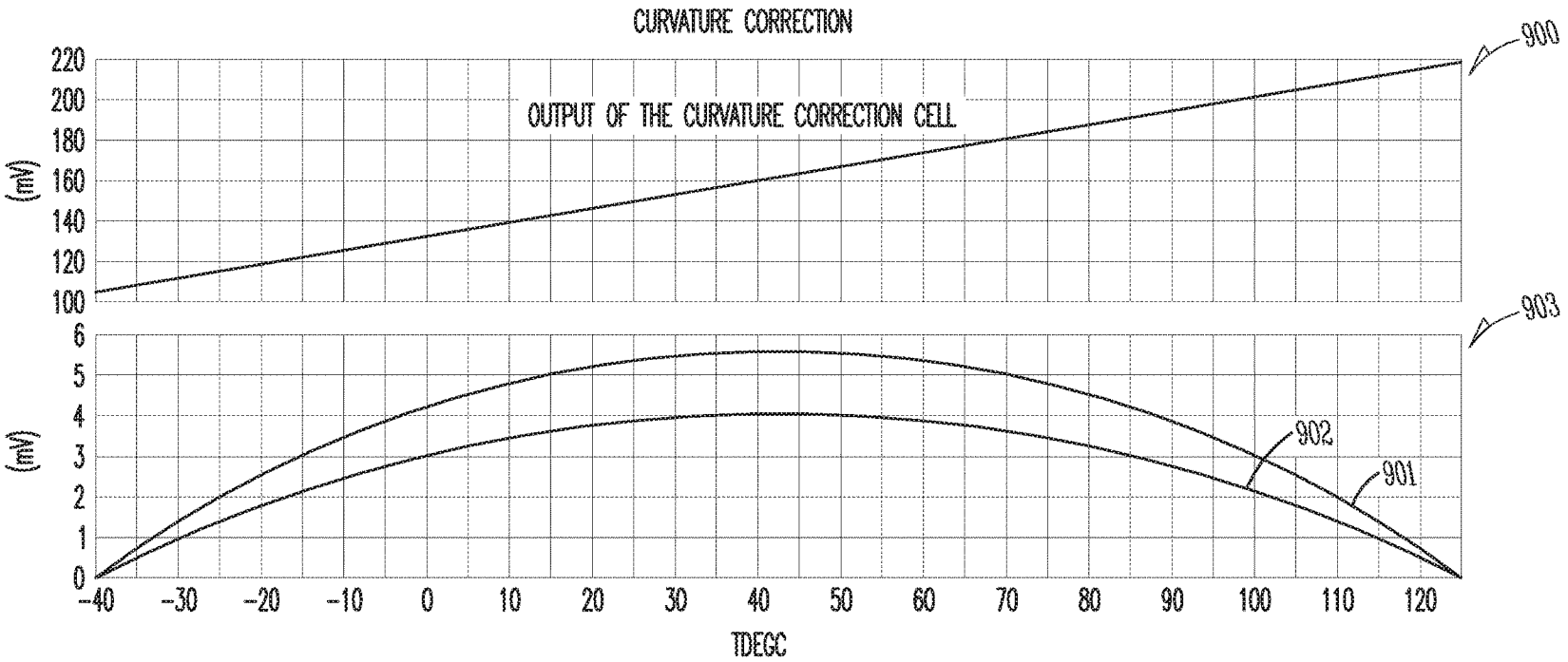
FIG. 9 are plots of an input delta-$V_{be}$ voltage compared to a corrected delta-$V_{be}$ voltage from the curvature correction circuit, such as in accordance with the embodiment of FIGS. 7 and 8.

FIG. 9 are plots of an input delta-$V_{be}$ voltage compared to a corrected delta-$V_{be}$ voltage from the curvature correction circuit 700, such as in accordance with the embodiments of FIGS. 7 and 8. The x-axis displays temperature in degrees Celsius and the y-axis displays mV.

The top plot 900 shows the output voltage added by the curvature correction circuit of FIG. 7. This voltage is added to the output of the delta-$V_{be}$ reference voltage circuit to correct for curvature of $V_{be}$. The bottom plot 903 shows the curvature of a $V_{be}$ reference voltage output 901 without the correction voltage added as compared to the curvature of a $V_{be}$ reference voltage 902 with the correction voltage added. The corrected voltage 902 is represented by V2 in the schematic of FIG. 8. It can be seen that the curvature correction voltage reduces the curvature of the $V_{be}$ reference voltage.

Figure 10:
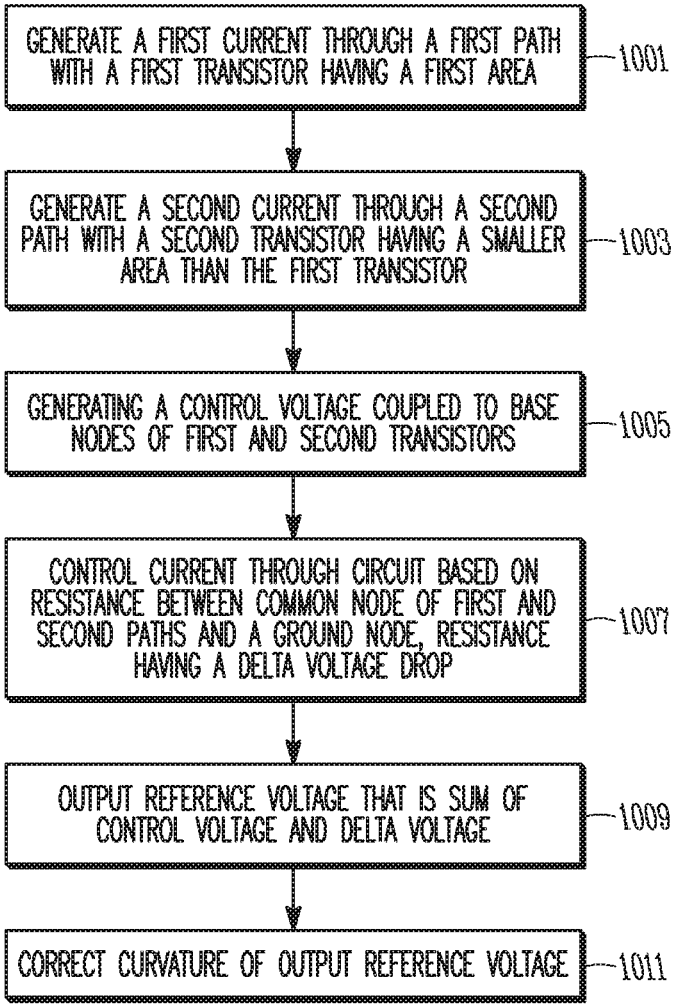
FIG. 10 is a flowchart of a method for delta-$V_{be}$ circuit operation, such as in accordance with various embodiments.

FIG. 10 is a flowchart of a method for delta-$V_{be}$ circuit operation, such as in accordance with various embodiments. In block 1001, a first current is generated through a first path that has a first transistor having a first collector current density. In block 1003, a second current is generated through a second path with a second transistor having a second collector current density that is less than the first collector current density. In block 1005, an input voltage (e.g., 2$V_{be}$) is generated and coupled to base nodes of the first and second transistors. In block 1007, a current through the reference voltage circuit is controlled based on a resistance between a common node between the first and second paths and a ground node for the reference circuit. The resistance has a 2$\Delta V_{be}$ voltage drop. In block 1009, the output reference voltage is generated that is the sum of the input voltage (e.g., 2$V_{be}$) and the 2$\Delta V_{be}$. In block 1011, the output reference voltage is corrected for curvature.

The above detailed description includes references to the accompanying drawings, which form a part of the detailed description. The drawings show, by way of illustration, specific embodiments in which the invention can be practiced. These embodiments are also referred to herein as "examples." All publications, patents, and patent documents referred to in this document are incorporated by reference herein in their entirety, as though individually incorporated by reference. In the event of inconsistent usages between this document and those documents so incorporated by reference, the usage in the incorporated reference(s) should be considered supplementary to that of this document; for irreconcilable inconsistencies, the usage in this document controls.

In this document, the terms "a" or "an" are used, as is common in patent documents, to include one or more than one, independent of any other instances or usages of"at least one" or "one or more." In this document, the term "or" is used to refer to a nonexclusive or, such that "A or B"

includes "A but not B," "B but not A," and "A and B," unless otherwise indicated. In the appended claims, the terms "including" and "in which" are used as the plain-English equivalents of the respective terms "comprising" and "wherein." Also, in the following claims, the terms "including" and "comprising" are open-ended, that is, a system, device, article, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects. Method examples described herein can be machine or computer-implemented at least in part.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description, with each claim standing on its own as a separate embodiment. The scope of the invention should be determined with reference to the appended claims, along with the full scope of equivalents to which such claims are entitled.

What is claimed is:

1. A bandgap reference voltage circuit for generating a temperature stable reference voltage output, the circuit comprising:

a plurality of paths, each path comprising a respective transistor coupled in series with a respective resistance, wherein a collector current density of the transistor in a first path of the plurality of paths is less than a collector current density of the respective transistors in other paths of the plurality of paths;

a current setting circuit or element connected to the end of the first path;

an input node of the circuit coupled to a base node of the transistor in the first path;

an output node of the circuit coupled to a base node of the transistor in the second path;

an amplifier circuit coupled between the respective transistors and resistances of each of the plurality of paths; and a current source coupled to a second end of each path, the current source coupled to and controlled by the amplifier circuit.

2. The circuit of claim 1, wherein each of the plurality of paths comprises a second transistor coupled in series with the transistor of each respective path.

3. The circuit of claim 2, further comprising an input path coupled to the input node, the input path comprising a first transistor coupled in series with a second transistor, each of the first and second transistors having the second area.

4. The circuit of claim 3, wherein each resistance is set in such a way as to control the collector current density of its respective transistor.

5. The circuit of claim 1, wherein the resistances of each path are thin film resistors.

6. The circuit of claim 1, wherein a respective current through each of the plurality of paths is determined by a ratio of the resistances.

7. The circuit of claim 1, wherein the current setting element is a resistor.

8. The circuit of claim 1, wherein base and collector nodes of each respective transistor are coupled together in a diode configuration.

9. The circuit of claim 1, in which at least one prior instance of the bandgap voltage reference circuit is arranged in a cascade with at least one subsequent of the bandgap voltage reference circuit, in which each subsequent instance of the bandgap voltage reference circuit is arranged to output a voltage that offset by $2*\Delta Vbe$ from its input voltage.

10. The circuit of claim 1, in which N instances of the bandgap voltage reference circuits are arranged in a cascade such that a final output reference voltage is represented by $2(V_{be}+N*\Delta V_{be})$.

11. A cascaded bandgap reference voltage circuit for generating a temperature stable reference voltage output, the cascaded circuit comprising:

a plurality of delta $V_{be}$ voltage circuits, each delta $V_{be}$ voltage circuit comprising:

a plurality of paths, each path comprising a respective transistor coupled in series with a respective resistance, wherein a collector current density of the transistor in a first path of the plurality of paths is lower than a collector current density of transistors in the other paths of the plurality of paths;

a resistance coupled between a reference voltage node and a first end of each path;

an path comprising a transistor having the second area, the input path coupled between the reference voltage node and a base of the transistors of the plurality of paths, an output node of the circuit coupled to the base of the transistors of the plurality of paths;

an amplifier circuit coupled between the respective transistors and resistances of each of the plurality of paths; and a current source coupled to a second end of each path, the current source coupled to and controlled by the operational amplifier; and a voltage curvature correction circuit coupled to the plurality of bandgap reference voltage circuits and configured to generate a curvature corrected reference voltage.

12. The cascaded circuit of claim 11, wherein the voltage curvature correction circuit comprises:

first and second paths, each path comprising a respective transistor and each transistor having a respective area, each transistor coupled in series with a respective resistance, wherein a collector current density of the transistor in the first path is lower than the collector current density of the transistor in the second path;

a first current source coupled between a common node of a first end of the first and second paths and a ground reference node;

an amplifier circuit coupled between the respective transistors and resistances of each of the first and second paths; and a second current source coupled to a common node of a second end of the first and second paths, the second current source coupled to and controlled by the amplifier circuit; and a third path coupled between the transistor and resistance of the second path and the common node of the second end;

wherein the first path comprises a first current, the second path comprise a second current, and the third path comprises a third current.

13. The cascaded circuit of claim 12, wherein the first current is an $I_{ZTAT}$ (zero to absolute temperature) current, the second current is a $I_{PTAT}$ (proportional to absolute temperature) current, and the third current is a $I_{CTAT}$ (complementary to absolute temperature) current.

14. The cascaded circuit of claim 13, wherein the first current source has a current equal to $I_{ZTAT}$.

15. The cascaded circuit of claim 14, wherein the first current source comprises a resistance in series with a transistor.

16. The cascaded circuit of claim 11, further comprising a capacitance coupled in parallel with the resistance of the first path.

17. The cascaded circuit of claim 11, in which each instance in the cascade is configured to output a voltage that is offset by 2*ΔVbe from its input voltage.

18. The cascaded circuit of claim 11, in which N instances of the bandgap voltage reference circuits are arranged in the cascade such that a final output reference voltage is represented by $2(V_{be}+N*\Delta V_{be})$.

19. A method for generating a temperature stable reference voltage in a reference voltage circuit, the method comprising:

generating a first current in a first path comprising a first transistor having a first collector current density;

generating a second current in a second path comprising a second transistor having a second collector current density, wherein the first collector current density is less than the second collector current density;

generating a control voltage that is coupled to a base node of the first and second transistors;

controlling a current through the reference voltage circuit based on a resistance between a common node of the first and second paths and a ground node, the resistance having a delta voltage between the common node and the ground node; and outputting the reference voltage that is a sum of the control voltage and the delta voltage.

20. The method of claim 19, further comprising correcting a curvature of the reference voltage.

21. The method of claim 20, wherein correcting the curvature of the reference voltage comprises adding a correction voltage to the reference voltage.

22. The method of claim 21, wherein the correction voltage is a substantially inverse voltage from the reference voltage.

23. The method of claim 19, wherein the output reference voltage is represented by $2(V_{be}+\Delta V_{be})$, wherein $2V_{be}$ is a base-to-emitter voltage of two bipolar junction transistors coupled in series and $2\Delta V_{be}$ is the delta voltage.

24. The method of claim 23, further comprising adding the reference voltage output of each of N reference voltage circuits that are cascaded such that a final output reference voltage is represented by $2(V_{be}+N*\Delta V_{be})$.

* * * * *